US009533192B2

(12) United States Patent
Maurice et al.

(10) Patent No.: US 9,533,192 B2
(45) Date of Patent: Jan. 3, 2017

(54) ASCENDER FOR ASCENDING ON A ROPE

(71) Applicant: ZEDEL, Crolles (FR)

(72) Inventors: Alain Maurice, Saint Hilaire du Touvet (FR); Pierre Plaze, Cruet (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 14/740,908

(22) Filed: Jun. 16, 2015

(65) Prior Publication Data

US 2016/0016042 A1 Jan. 21, 2016

(30) Foreign Application Priority Data

Jul. 18, 2014 (FR) ..... 14 01632

(51) Int. Cl.
*A63B 29/02* (2006.01)
*A62B 1/14* (2006.01)

(52) U.S. Cl.
CPC . *A63B 29/02* (2013.01); *A62B 1/14* (2013.01)

(58) Field of Classification Search
CPC ..... A63B 29/02; A62B 1/14; A62B 35/04; A62B 35/0081
See application file for complete search history.

(56) References Cited

U.S. PATENT DOCUMENTS 3,492,702 A 2/1970 Stafford
3,811,155 A * 5/1974 Stafford ..... A62B 1/14 182/5
4,502,668 A * 3/1985 Dodge, Jr. ..... A62B 1/14 182/192
4,542,884 A * 9/1985 Dodge, Jr. ..... A62B 1/14 182/5
4,667,772 A 5/1987 Kammerer
5,323,873 A * 6/1994 Pelofi ..... A62B 35/04 182/192
5,664,640 A * 9/1997 Smith ..... A62B 1/14 182/193
5,845,894 A * 12/1998 Petzl ..... A62B 1/14 254/391
5,924,522 A * 7/1999 Ostrobrod ..... A62B 1/14 182/191
6,095,502 A * 8/2000 Dodge, Jr. ..... A62B 1/14 182/5

(Continued)

FOREIGN PATENT DOCUMENTS

DE 102010023264 A1 12/2011
EP 1525903 A1 4/2005

*Primary Examiner* — Xuan Lan Nguyen
(74) *Attorney, Agent, or Firm* — Oliff PLC

(57) ABSTRACT

Ascender for ascending on a rope, comprising a U-shaped clamp equipped with two lateral wings delineating an internal space for passage of the rope, and with an arresting surface with spikes against which the rope is blocked in case of a fall. The two wings are provided with two openings arranged facing one another and each having an edge in the form of an inclined ramp performing guiding of a karabiner passing through the two openings. The clamp comprises a mobile control part biased by a spring to an active actuation position of the karabiner along the ramp for the rope to come into contact against the arresting surface with spikes, so as to obtain a first ready-to-block state when ascending on the rope, and a second blocking state of the clamp on the rope in the event of a fall.

7 Claims, 3 Drawing Sheets

(56) References Cited

U.S. PATENT DOCUMENTS

| | | | | |
|---|---|---|---|---|
| 6,793,046 | B2 * | 9/2004 | Petzl | A62B 35/04<br>188/188 |
| 2002/0112916 | A1 * | 8/2002 | Ador | A62B 1/14<br>182/5 |
| 2005/0082115 | A1 | 4/2005 | Petzl et al. | |
| 2006/0102421 | A1 | 5/2006 | Dionne | |

* cited by examiner

ASCENDER FOR ASCENDING ON A ROPE

BACKGROUND OF THE INVENTION

The invention relates to a safety ascender for ascending on a rope, comprising a U-shaped clamp equipped with two lateral wings delineating an internal space for passage of the rope, and with an arresting surface with spikes against which the rope is blocked in case of a fall, the two wings being provided with two openings arranged facing one another and each having an edge in the form of an inclined ramp performing guiding of a karabiner passing through the two openings.

STATE OF THE ART

A known ascender of the kind mentioned is described in the document U.S. Pat. No. 4,667,772. A karabiner passes through the two apertured wings of the ascender and is generally connected by a lanyard to the user's harness to ensure progression when ascending along a rope fixed higher up. On a fixed rope, nothing triggers blocking in the absence of any user action. To avoid any risk of blocking not taking place due to free sliding of the ascender in the downwards direction, blocking can be triggered by a specific action which consists in pulling the bottom of the karabiner towards the bottom of the openings, which enables the ascender to be held against the rope, which then itself comes into contact with the spiked arresting surface. In case of the user panicking in the event of a fall, if he or she tensed up and grabbed hold of the ascender clamp, blocking of the rope would be insufficient or delayed. User safety is therefore not automatic, as it depends on the manual action consisting in continuously pulling the karabiner downwards to trigger pre-blocking.

The document DE 102010023264 also relates to an ascender of the same type as in the foregoing, but the clamp is not in a single part and comprises a spiked arresting surface able to swivel elastically with respect to the lateral wings of the clamp according to the diameter of the rope which is used. At each blocking, the karabiner is initially in the up position and slides downwards. This results in a loss of efficiency when ascending on a rope. In addition, no means are provided to be able to make the ascender slide downwards.

OBJECT OF THE INVENTION

The object of the invention consists in providing an ascender with a U-shaped clamp associated with a karabiner designed to guarantee blocking without any delay in case of a fall, independently from the diameter of the rope and without requiring any particular manual action.

The ascender according to the invention is characterized in that the clamp comprises a mobile control part biased by a spring to an active actuation position of the karabiner along the ramp for the rope to come into contact against the arresting surface so as to obtain a first ready-to-block state when ascending on the rope, and a second blocking state of the clamp on the rope in the event of a fall.

The first ready-to-block state is obtained automatically due to the presence of the spring which acts on the karabiner to trigger pre-blocking. The calibration of the spring is chosen such that the rope touches the spikes of the arresting surface slightly without hindering ascension on the rope. In the first ready-to-block state, the pressure exerted by the rope on the arresting surface is considerably lower than that exerted in the second blocking state.

According to a preferred embodiment, the control part is articulated around a pin provided at the top part of the clamp, said part being movable with a limited swiveling movement between the active position pressing on the top of the clamp and an inactive position away from the clamp. The control part comprises at least one lateral extension extending in parallel manner outside the corresponding wing to drive the karabiner when movement takes place to the active position.

According to one feature of the invention, the spring used for pre-blocking is a compression spring fitted between a stud of the clamp and a curved nose of the control part. It can also be replaced by a torsion spring fitted on the swivel-pin of the control part.

According to another feature, the control part is provided with a gripper designed to drive it to the inactive position by a deliberate manual action allowing a controlled descent movement along the rope. This action causes compression of the spring.

BRIEF DESCRIPTION OF THE DRAWINGS

Other advantages and features will become more clearly apparent from the following description of an embodiment of the invention given for non-restrictive example purposes only and represented in the appended drawings, in which.

DESCRIPTION OF A PARTICULAR EMBODIMENT

Figure 1:
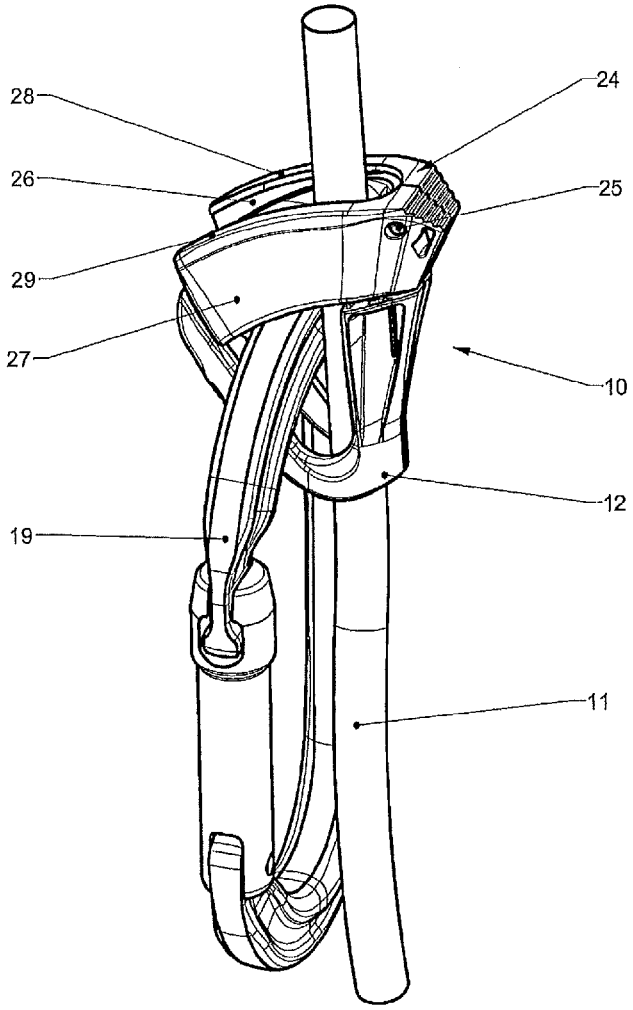
FIG. 1 is a perspective view of the ascender according to the invention, fitted on a rope in association with a karabiner.

With reference to the figures, an ascender 10 for a rope 11 comprises a U-shaped metal clamp 12 having two parallel lateral wings 13, 14 delineating an internal space 15 for passage of rope 11. At the bottom of clamp 12, the two wings 13, 14 are connected to one another by an arresting surface 16 equipped with spikes 17.

Spikes 17 are arranged on a large part of arresting surface 16, being slightly inclined downwards. The angle of incline of spikes 17 is arranged to allow sliding of ascender 10 without damaging the sheath of rope 11 in the ascending direction.

The two lateral wings 13, 14 present identical structures, comprising two openings 18 arranged facing one another. In the event of the user falling, rope 11 is blocked against arresting surface 16 by means of a karabiner 19 passing through the two openings 18 (FIG. 1) and acting in pressure on rope 11 due to the action of the user's weight.

Opening 18 of each wing 13, 14 is delineated by a closed contour comprising a vertical first edge 20 and an oblique second edge 21 connected to one another at the bottom part by a V-shaped curved recess 22, forming an acute angle. The second edge forms an inclined ramp for guiding karabiner 19. A third edge 23 connects the other two edges 20, 21 at the broadened top part to close the contour.

Figure 4:
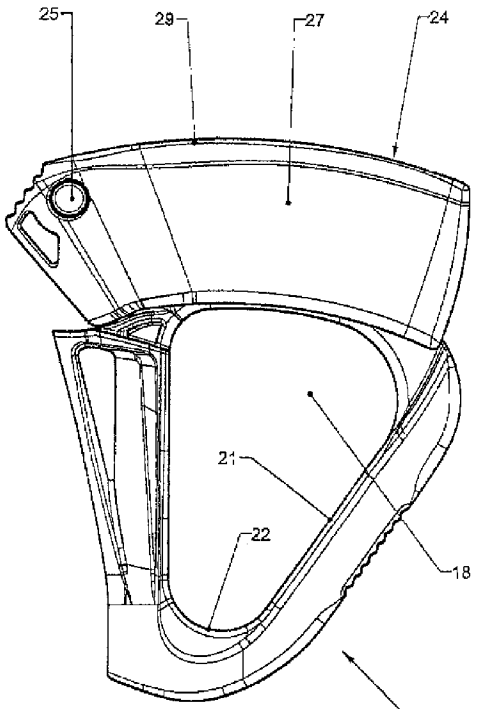
FIG. 4 represents a side view of FIG. 3.
Figure 3:
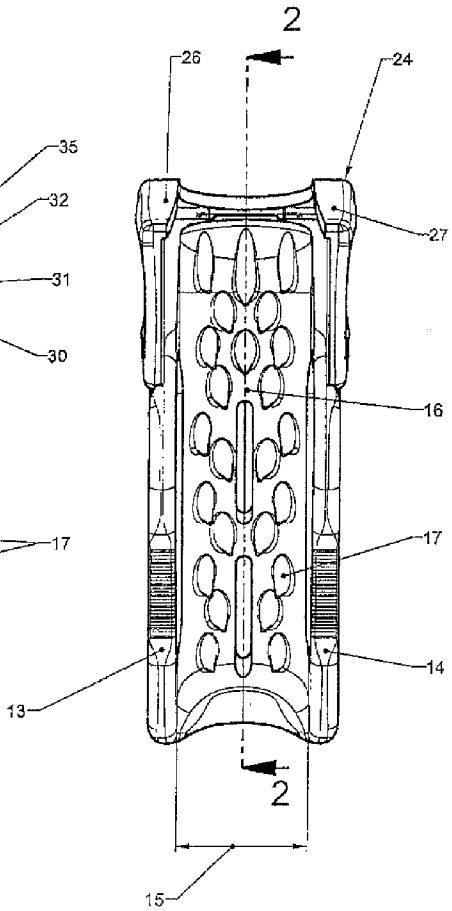
FIG. 3 shows the inside of the ascender of FIG. 2, with the spiked arresting surface, arranged at the bottom of the two wings of the clamp.
Figures 5, 6, 7:
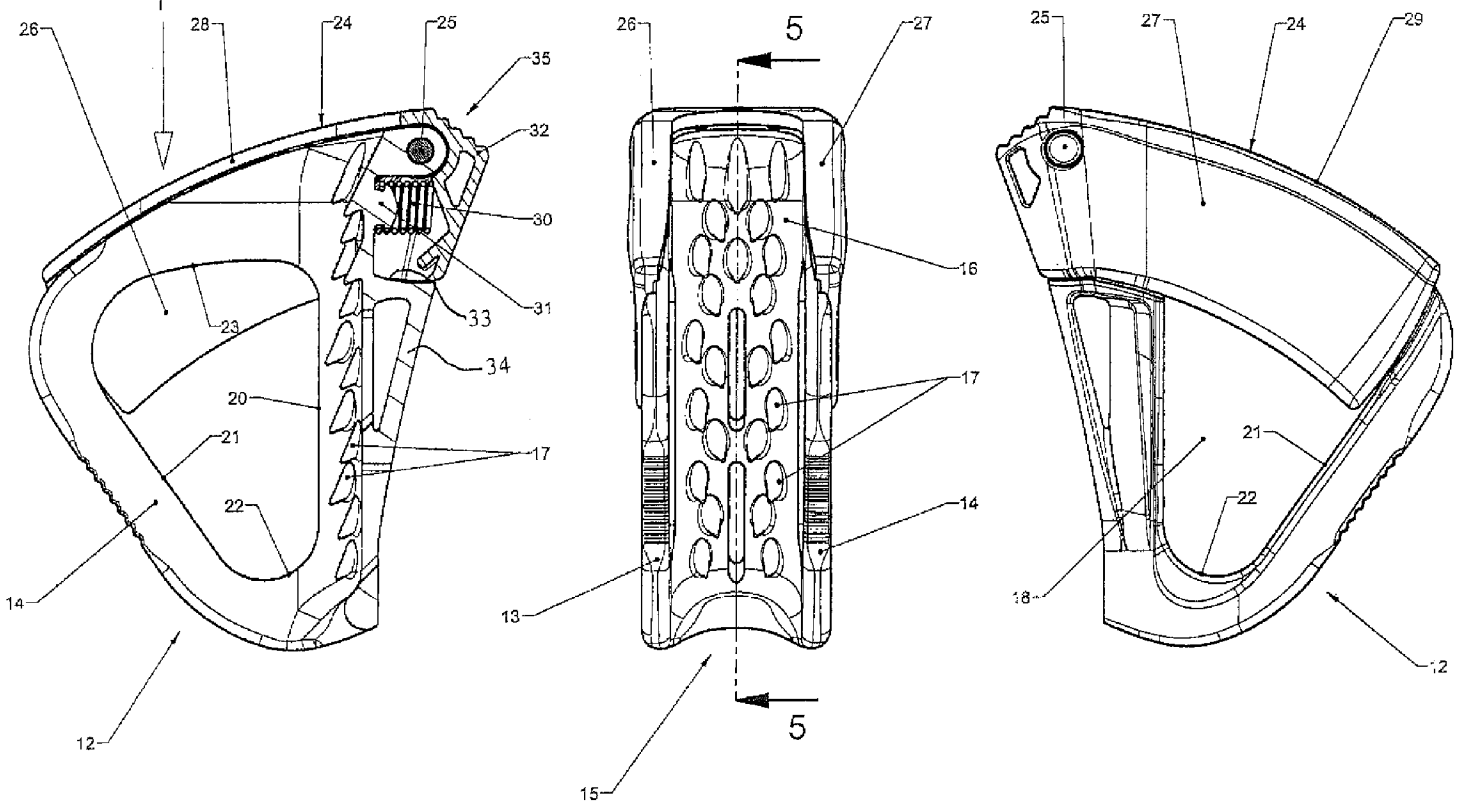
FIGS. 5 to 7 are identical views to FIGS. 2 to 4, when the control part is in the active position.

According to the invention, ascender 10 further comprises a control part 24 articulated around a pin 25 provided at the top of the fixed clamp 12, close to arresting surface 16. This control part 24 in the form of a rider can move with a limited swiveling movement, able to occupy an inactive position (FIGS. 2 to 4) or an active position (FIGS. 5 to 7).

The U-shaped rider of part 24 for this purpose comprises two lateral extensions 26, 27 vertically surrounding the top part of wings 13, 14 with a small clearance, allowing passage of rope 11 in the central part. The separating distance between the two extensions 26, 27 of control part 24 is thus slightly larger than that of wings 13, 14 of clamp 12. Each extension 26, 27 is provided with an edge 28, 29 in the form of a bracket pressing on the top of the respective wings 13, 14 when the rider is in the active position (FIG. 5). In this active position, the bottom of extensions 26, 27 partially blocks the top part of openings 18. The bottom edge of each extension 26, 27 thus constitutes actuation means of karabiner 19 when the rider moves to the active position.

Figure 2:
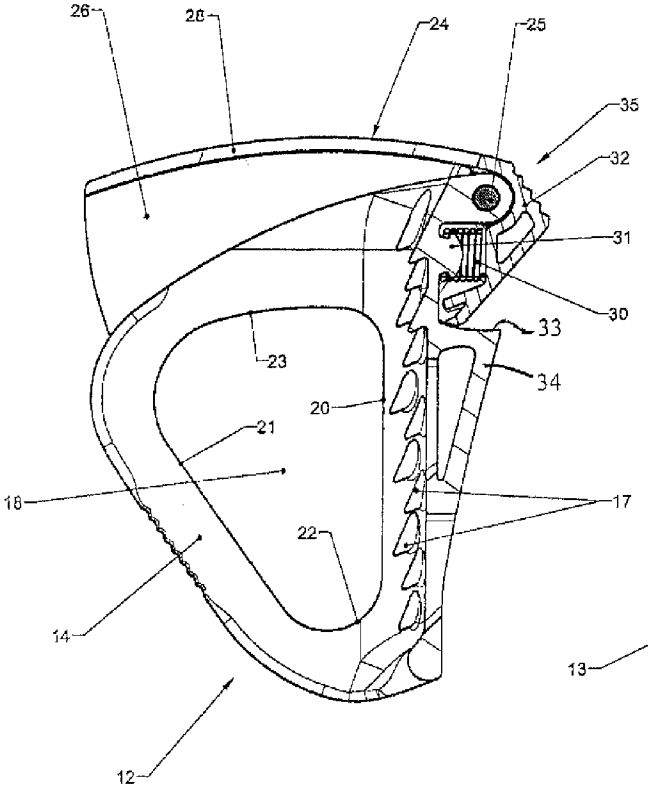
FIG. 2 shows a cross-sectional view along the line 2-2 of FIG. 3, the control part being represented in the inactive position.

A spring 30 collaborates with control part 24 to bias it to the active actuation position of karabiner 19 causing rope 11 to come into contact against arresting surface 16. In the example of FIGS. 2 and 5, spring 30 is a compression spring which is fitted between a stud 31 of clamp 12 and a curved nose 32 of control part 24. The end of nose 32 moves along a slightly concave guiding surface 33 arranged on a protuberance 34 of clamp 12. In the inactive position, compression spring 30 is in the compressed state (FIG. 2), and in the relaxed state (FIG. 5) it is in the active position of control part 24. In the inactive position, karabiner 19 is not biased by control part 24.

It is clear that any other type of spring, in particular a torsion spring fitted on pin 25, or any flexible part designed to act on karabiner 19, can be used.

To perform movement to the active position of FIG. 5, relaxation of spring 30 suffices, but it is also possible to press on control part 24 in the direction of arrow F. Extensions 26, 27 push karabiner 19 downwards, and the reaction of the latter on the ramp of second edge 21 of wings 13, 14 urges karabiner 19 against rope 11, which comes and presses against arresting surface 16. The calibration of the spring 30 moves the rope up against arresting surface 16, without causing definitive blocking of the ascender. This results in a first "ready-to-block" state with triggering of pre-blocking, which allows ascension on the rope, and which enables efficient blocking of ascender 10 on rope 11 to be obtained without any delay in the event of a fall. If the user holds the rope above clamp 12 of ascender 10, his or her hand will come and press on control part 24, which confirms the first "ready-to-block" state. Relaxation of spring 30 also acts in the direction of arrow F and enables the same position to be obtained without pressing on the top of control part 24.

Control part 24 is further provided with a gripper 35 designed to drive it to the inactive position (FIG. 2) by a deliberate manual action disabling blocking. It is then possible to initiate a controlled descent movement along the rope.

Different variants are possible to achieve control part 24. Instead of being swiveling, the part can be actuated in translation. Instead of having a double rider with two lateral extensions 26, 27, the part could be equipped with a single extension acting on one side of karabiner 19 only.

Control part 24 can be made from plastic or from metal.

The ascender according to the invention can be used for climbing, pot-holing and for working at heights.

The invention claimed is:

1. A safety ascender for ascending on a rope, comprising:

a U-shaped clamp equipped with (i) two lateral wings delineating an internal space for passage of the rope, and (ii) a spiked arresting surface against which the rope is blocked in case of a fall, the spiked arresting surface being stationary relative to the two lateral wings, the two lateral wings being provided with two openings arranged facing one another and each having an edge in the form of an inclined ramp performing guiding of a karabiner passing through the two openings, wherein the clamp comprises:

a mobile control part mounted on the top of the two lateral wings, and a spring arranged for biasing said mobile control part to an active actuation position of the karabiner along the inclined ramp for the rope to come into contact against the stationary spiked arresting surface, so as to obtain (a) a first ready-to-block state when ascending on the rope, and (b) a second blocking state of the clamp on the rope in the event of a fall, and wherein said mobile control part is movable with a limited movement between the active actuation position pressing on top of the clamp and an inactive position away from the clamp.

2. The ascender according to claim 1, wherein the spring is configured to initiate pre-blocking of the rope in the first ready-to-block state.

3. The ascender according to claim 1, wherein the mobile control part comprises a rider articulated around a pin provided at the top of the clamp, so as to move with a limited swiveling movement between the active actuation position and the inactive position.

4. The ascender according to claim 3, wherein the mobile control part comprises at least one lateral extension extending in parallel manner outside the corresponding lateral wing to drive the karabiner when movement takes place to the active position.

5. The ascender according to claim 3, wherein the spring is a compression spring fitted between a stud of the clamp and a curved nose of the mobile control part.

6. The ascender according to claim 3, wherein the spring is a torsion spring fitted on the swivel-pin of the mobile control part.

7. The ascender according to claim 3, wherein the mobile control part is provided with a gripper designed to drive it to the inactive position by a deliberate manual action allowing a controlled descent movement along the rope.

* * * * *